US012179081B1

(12) United States Patent
Zhao

(10) Patent No.: US 12,179,081 B1
(45) Date of Patent: Dec. 31, 2024

(54) PORTABLE PUTTING DRILL SYSTEM AND METHODS OF USING THE SAME

(71) Applicant: Yansheng Zhao, Duluth, GA (US)

(72) Inventor: Yansheng Zhao, Duluth, GA (US)

( * ) Notice: Subject to any disclaimer, the term of this patent is extended or adjusted under 35 U.S.C. 154(b) by 0 days.

(21) Appl. No.: 18/542,671

(22) Filed: Dec. 16, 2023

(51) Int. Cl.
*A63B 69/36* (2006.01)
*A63B 24/00* (2006.01)

(52) U.S. Cl.
CPC ..... *A63B 69/3614* (2013.01); *A63B 24/0003* (2013.01); *A63B 69/3676* (2013.01)

(58) Field of Classification Search
CPC ..... A63B 69/3614; A63B 24/0003; A63B 69/3676
See application file for complete search history.

(56) References Cited

U.S. PATENT DOCUMENTS 5,330,188 A * 7/1994 Reimers ..... A63B 69/3614 473/240
11,642,583 B1 * 5/2023 Stroffolino ..... A63B 71/0622 473/226
2003/0054898 A1 * 3/2003 Otten ..... A63B 69/3614 473/219
2008/0300699 A1 * 12/2008 Smith, Jr. ..... A63B 69/36 700/93
2009/0326688 A1 * 12/2009 Thomas ..... A63B 69/362 473/409
2015/0182837 A1 * 7/2015 Burke ..... A63B 24/0021 473/225
2021/0220718 A1 * 7/2021 Tuxen ..... A63B 24/0021
2021/0362025 A1 * 11/2021 Park ..... A63B 69/3685
2022/0362644 A1 * 11/2022 Park ..... A63B 60/46
2022/0400202 A1 * 12/2022 Imes ..... H04N 5/77

* cited by examiner

*Primary Examiner* — Eugene L Kim
*Assistant Examiner* — Christopher Glenn
(74) *Attorney, Agent, or Firm* — Ming Jiang; MM IP SERVICES LLC

(57) ABSTRACT

Present disclosure relates to a portable putting drill system. The portable putting drill system includes a sensor array, a drill data collection circuit, and a mobile electronic device. The sensor array collects putting drill data including a striking speed, striking angle of a putter, and whether putter hits its sweet spot. Drill data collection circuit includes a data collection circuit for receiving the putting drill data collected by the sensor array, a data processing circuit for processing the putting drill data received, a data reporting circuit for reporting results of the putting drill data processed, and a wireless connection circuit for transmitting the results of putting drill data processed to a mobile electronic device wirelessly over a communication network. Mobile electronic device displays processed putting drill data, provides audio output to a user in real time to enhance putting drill experience, and saves historic statistics of putting drill data.

4 Claims, 9 Drawing Sheets

32

| 320 | 321 | 3221 | 322 | 3222 | 3231 | 323 | 3232 | 3241 | 324 | 3242 | 3251 | 325 | 3252 |
|---|---|---|---|---|---|---|---|---|---|---|---|---|---|
| Strike No. (20/set) | Putter Speed (mph) | Pre-strike Angle | | | Post-strike Angle | | | Pre-strike(D1-D3) | | | Post-strike(D2-D4) | | |
| | | Open (degree) | | Close (degree) | Open (degree) | | Close (degree) | Down (Inch) | | Up (Inch) | Down (Inch) | | Up (Inch) |
| 1 | 2.20 | 3.50 | | | | | 5.60 | 1.10 | | | 0.90 | | |
| 2 | 2.60 | | | 1.70 | | | 5.60 | 1.30 | | | 1.00 | | |
| 3 | 2.00 | 3.50 | | | 0.10 | | | | | 0.80 | | | 1.10 |
| 4 | 2.23 | 3.50 | | | | | 5.70 | | | 1.20 | | | 1.40 |
| 5 | 2.61 | 3.50 | | | 4.60 | | | 0.80 | | | 1.10 | | |
| 6 | 2.61 | 3.50 | | | 4.60 | | | 1.40 | | | 0.80 | | |
| 7 | 2.61 | | | 6.40 | 4.80 | | | 0.60 | | | 0.80 | | |
| 8 | 2.22 | | | 6.40 | | | 11.90 | 0.40 | | | 1.20 | | |
| 9 | 2.24 | 3.60 | | | | | 1.66 | 0.00 | | 0.00 | 0.00 | | 0.00 |
| 10 | 2.26 | | | 2.00 | | | 5.60 | | | 1.20 | | | 0.80 |
| 11 | 2.27 | 3.60 | | | | | 5.70 | 0.70 | | | | | 1.80 |
| 12 | 2.22 | 3.50 | | | | | 5.70 | 1.10 | | | 0.80 | | |
| 13 | 2.20 | 3.50 | | | 0.10 | | | | | 0.90 | | | 0.90 |
| 14 | 2.28 | | | 6.30 | | | 5.70 | | | 1.30 | | | 0.50 |
| 15 | 2.60 | | | 1.80 | | | 5.70 | | | 0.70 | | | 0.70 |
| 16 | 2.61 | | | 1.30 | | | 5.70 | 0.90 | | | 1.20 | | |
| 17 | 2.20 | 3.70 | | | 8.50 | | | 0.40 | | | | | 0.90 |
| 18 | 2.22 | 3.50 | | | | | 5.70 | 0.80 | | | 1.30 | | |
| 19 | 2.22 | | | 6.30 | | | 5.70 | 0.00 | | 0.00 | 0.00 | | 0.00 |
| 20 | 2.23 | 3.70 | | | | | 5.80 | | | 0.50 | | | 1.20 |
| Average Offset (326) | 2.33 | 3.55 | | 4.03 | 3.78 | | 5.85 | 0.86 | | 0.94 | 1.01 | | 1.03 |
| Offset percentage (327) | 16.50% | 60% | | 40% | 30% | | 70% | 55% | | 35% | 45% | | 45% |

FIG. 8

PORTABLE PUTTING DRILL SYSTEM AND METHODS OF USING THE SAME

FIELD

The present disclosure generally relates to golf practice, and more particularly to a sensor array, a portable putting drill system using the sensor array, and methods of using the portable putting drill system having the sensor array.

BACKGROUND

In order to improve golf putting skills, golfers usually need to practice on the golf courses or similar training facilities, which is very expensive and time consuming. There are a few practice machines to use on the golf courses or training facilities, but they are very expensive and very difficult to use without going to golf courses or training facilities. It is desirable to develop a golf drill system that is inexpensive, and suitable to practice at home without paying expensive facility fees, and that measures offsets of the putting, in terms of putting speed, club angles, and accuracy of golf ball striking, and report the measurements to a golfer in real time during a putting drill to coach the golfer and improve his/her golf skills.

Therefore, heretofore unaddressed needs still exist in the art to address the aforementioned deficiencies and inadequacies.

SUMMARY

In one aspect, the present disclosure relates to a sensor array. In certain embodiments, the sensor array includes: a first sensor, a second sensor, a third sensor, and a fourth sensor. The first sensor and the second sensor are installed on a first sensor support member. The third sensor and the fourth sensor are installed on a second sensor support member. The first sensor, the second sensor, the third sensor and the fourth sensor form a rectangle shape. The first sensor and the third sensor form a pre-strike reference line, and the second sensor and the fourth sensor form a post-strike reference line. The sensor array collects putting drill data, and the putting drill data includes a striking speed of a putter, a striking angle of the putter, and whether a striking surface of the putter hits a sweet spot of the putter.

In certain embodiments, the sensor array includes at least one of: a set of laser sensors, a set of optical sensors, a set of ultrasonic sensors, a set of electromagnetic sensors, and a combination of these sensors.

In certain embodiments, when a first end of the putter travels between the first sensor and the second sensor, a time travelled by the first end of the putter between the first sensor and the second sensor determines a first striking speed of the putter. When a second end of the putter travels between the third sensor and the fourth sensor, a time travelled by the second end of the putter between the third sensor and the fourth sensor determines a second striking speed of the putter. The striking speed of the putter is an average of the first striking speed of the putter and the second striking speed of the putter.

In certain embodiments, when the putter is swing from right to left passing the pre-strike reference line between the first sensor and the third sensor, the first sensor and the third sensor detects a pre-striking angle of the putter. When the putter is swing from right to left passing the post-strike reference line between the second sensor and the fourth sensor, the second sensor and the fourth sensor detects a post-striking angle of the putter, and the striking angle of the putter is an average of the pre-striking angle of the putter and the post-striking angle of the putter.

In certain embodiments, when the putter is swing from right to left passing the pre-strike reference line between the first sensor and the third sensor, the first sensor detects a first distance D1 between the first end of the putter to the first sensor, and the third sensor detects a third distance D3 between the second end of the putter to the third sensor, when the putter is swing from right to left passing the post-strike reference line between the second sensor and the fourth sensor, the second sensor detects a second distance D2 between the first end of the putter to the second sensor, and the fourth sensor detects a fourth distance D4 between the second end of the putter to the fourth sensor, and when the first distance D1 equals the third distance D3, and the second distance D2 equals the fourth distance D4, the putter hits the sweet spot of the putter.

In another aspect, the present disclosure relates to a portable putting drill system. In certain embodiments, the portable putting drill system includes: a sensor array, a drill data collection circuit, and a mobile electronic device. The sensor array collects putting drill data including a striking speed of a putter, a striking angle of the putter, and whether a striking surface of the putter hits a sweet spot of the putter. The drill data collection circuit includes: a data collection circuit for receiving the putting drill data collected by the sensor array, a data processing circuit for processing the putting drill data received, a data reporting circuit for reporting the results of putting drill data processed, and a wireless connection circuit for transmitting the results of putting drill data processed to the mobile electronic device wirelessly over a communication network. The mobile electronic device displays the processed putting drill data, and provides audio output to a user in real time to enhance the putting drill experience.

In certain embodiments, the sensor array includes: a first sensor, a second sensor, a third sensor, and a fourth sensor. The first sensor and the second sensor are installed on a first sensor support member. The third sensor and the fourth sensor are installed on a second sensor support member. The first sensor, the second sensor, the third sensor and the fourth sensor form a rectangle shape. The first sensor and the third sensor form a pre-strike reference line, and the second sensor and the fourth sensor form a post-strike reference line. The sensor array collects putting drill data.

In certain embodiments, the sensor array includes at least one of: a set of laser sensors, a set of optical sensors, a set of ultrasonic sensors, a set of electromagnetic sensors, and a combination of these sensors.

In certain embodiments, when a first end of the putter travels between the first sensor and the second sensor, a time travelled by the first end of the putter between the first sensor and the second sensor determines a first striking speed of the putter. When a second end of the putter travels between the third sensor and the fourth sensor, a time travelled by the second end of the putter between the third sensor and the fourth sensor determines a second striking speed of the putter. The striking speed of the putter is an average of the first striking speed of the putter and the second striking speed of the putter.

In certain embodiments, when the putter is swing from right to left passing the pre-strike reference line between the first sensor and the third sensor, the first sensor and the third sensor detects a pre-striking angle of the putter. When the putter is swing from right to left passing the post-strike reference line between the second sensor and the fourth sensor, the second sensor and the fourth sensor detects a post-striking angle of the putter, and the striking angle of the putter is an average of the pre-striking angle of the putter and the post-striking angle of the putter.

In certain embodiments, when the putter is swing from right to left passing the pre-strike reference line between the first sensor and the third sensor, the first sensor detects a first distance D1 between the first end of the putter to the first sensor, and the third sensor detects a third distance D3 between the second end of the putter to the third sensor, when the putter is swing from right to left passing the post-strike reference line between the second sensor and the fourth sensor, the second sensor detects a second distance D2 between the first end of the putter to the second sensor, and the fourth sensor detects a fourth distance D4 between the second end of the putter to the fourth sensor, and when the first distance D1 equals the third distance D3, and the second distance D2 equals the fourth distance D4, the putter hits the sweet spot of the putter.

In certain embodiments, the communication network includes: a Wi-Fi network, a Bluetooth network, an infrared network, a Zigbee network, a wireless local area network (WLAN), a wireless metropolitan area network (WMAN), a wireless wide area network (WWAN), a cellular network, and a mobile communication network.

In certain embodiments, the mobile electronic device includes: an Apple iPad, a mobile smart phone, and a tablet computer.

In certain embodiments, the putting drill data is displayed on the mobile electronic device in real time during the putting drill for the user to view, and audio output of the mobile electronic device provides coaching in real time during the drill to improve the putting drill. The user receives the audio output of the mobile electronic device through an audio output device. The audio output device of the mobile electronic device includes an internal speaker of the mobile electronic device, wirelessly connected earphones, earbuds, headsets, headphones and Apple AirPods.

In certain embodiments, the portable putting drill system further includes a rechargeable battery. The rechargeable battery includes at least one of: a lead-acid rechargeable battery, a nickel cadmium (NiCd) rechargeable battery, a nickel metal hydride (NiMH) rechargeable battery, a lithium ion (Li-ion) rechargeable battery, and a lithium-ion polymer (Li-ion polymer) rechargeable battery.

In another aspect, the present disclosure relates to a method of using a portable putting drill system. In certain embodiments, the method includes following operations:

setting up, by a user, the portable putting drill system on a green of a golf course or on an indoor putting drill area, and the portable putting drill system includes a sensor array, a drill data collection circuit, and a mobile electronic device;

entering, by the user on the mobile electronic device, a set of putting drill information and goal on mobile electronic device. The putting drill information and goal includes: name of putting drill participant, the date of the putting drill, the location of the putting drill, projected putter speed in miles per hour, Green Rate, golf course slop, angle between the club hole and the fairway, and number of putting drill for each round. including a predetermined striking speed, and number of strikes for each round;

starting, by the user, a putting drill by setting a counter to zero, and swing a gold putter at a golf ball 150 positioned at a center of the sensor array from right to left;

collecting, by the drill data collection circuit through the sensor array, putting drill data after each putter strike, and the putting drill data includes a striking speed of a putter, a striking angle of the putter, and whether a striking surface of the putter hits a sweet spot of the putter;

incrementing the counter by one after each putter strike, and the drill data collection circuit collects putting drill data for this strike through the sensor array, processes the putting drill data, and reports to the user through the mobile electronic device for audio or visual feedback to the user;

displaying, by the mobile electronic device after each putter strike, statistics of current round of putting drill data for the user to review, and audio and visual feedback to the user to improve future putting drill;

when the counter of the mobile electronic device does not reach the number of strikes for each round, the method continues to collecting putting drill data step;

when the counter of the mobile electronic device reaches the number of strikes for each round, the method asks the user whether to continue the putting drill, or end the putting drill;

the method continues to start over another round of putting drill when the user chooses to continue the putting drill;

the method ends when the user chooses to terminate the putting drill.

In certain embodiments, the portable putting drill system includes: the sensor array, the drill data collection circuit, and the mobile electronic device. The sensor array collects putting drill data. The drill data collection circuit includes: a data collection circuit for receiving the putting drill data collected by the sensor array, a data processing circuit for processing the putting drill data received, a data reporting circuit for reporting the results of putting drill data processed, and a wireless connection circuit for transmitting the results of putting drill data processed to the mobile electronic device wirelessly over a communication network. The mobile electronic device displays the processed putting drill data, and provides audio output to a user in real time to enhance the putting drill experience.

In certain embodiments, the sensor array includes: a first sensor, a second sensor, a third sensor, and a fourth sensor. The first sensor and the second sensor are installed on a first sensor support member, and the third sensor and the fourth sensor are installed on a second sensor support member. The first sensor, the second sensor, the third sensor and the fourth sensor form a rectangle shape. The first sensor and the third sensor form a pre-strike reference line, and the second sensor and the fourth sensor form a post-strike reference line. The sensor array collects putting drill data, and the sensor array includes at least one of: a set of laser sensors, a set of optical sensors, a set of ultrasonic sensors, a set of electromagnetic sensors; and a combination of these sensors.

In certain embodiments, the mobile electronic device includes an Apple iPad, a mobile smart phone, and a tablet computer. The user receives the audio output of the mobile electronic device through an audio output device, and the audio output device of the mobile electronic device includes an internal speaker of the mobile electronic device, wirelessly connected earphones, earbuds, headsets, headphones and Apple AirPods.

These and other aspects of the present disclosure will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the present disclosure, and features and benefits thereof, and together with the written description, serve to explain the principles of the present invention. Wherever possible, the same reference numbers are used throughout the drawings to refer to the same or like elements of an embodiment, and wherein:

FIG. 8 illustrates an exemplary report form show the statistics of offsets during a round of putting drill according to certain embodiments of the present disclosure.

DETAILED DESCRIPTION

Figure 1:
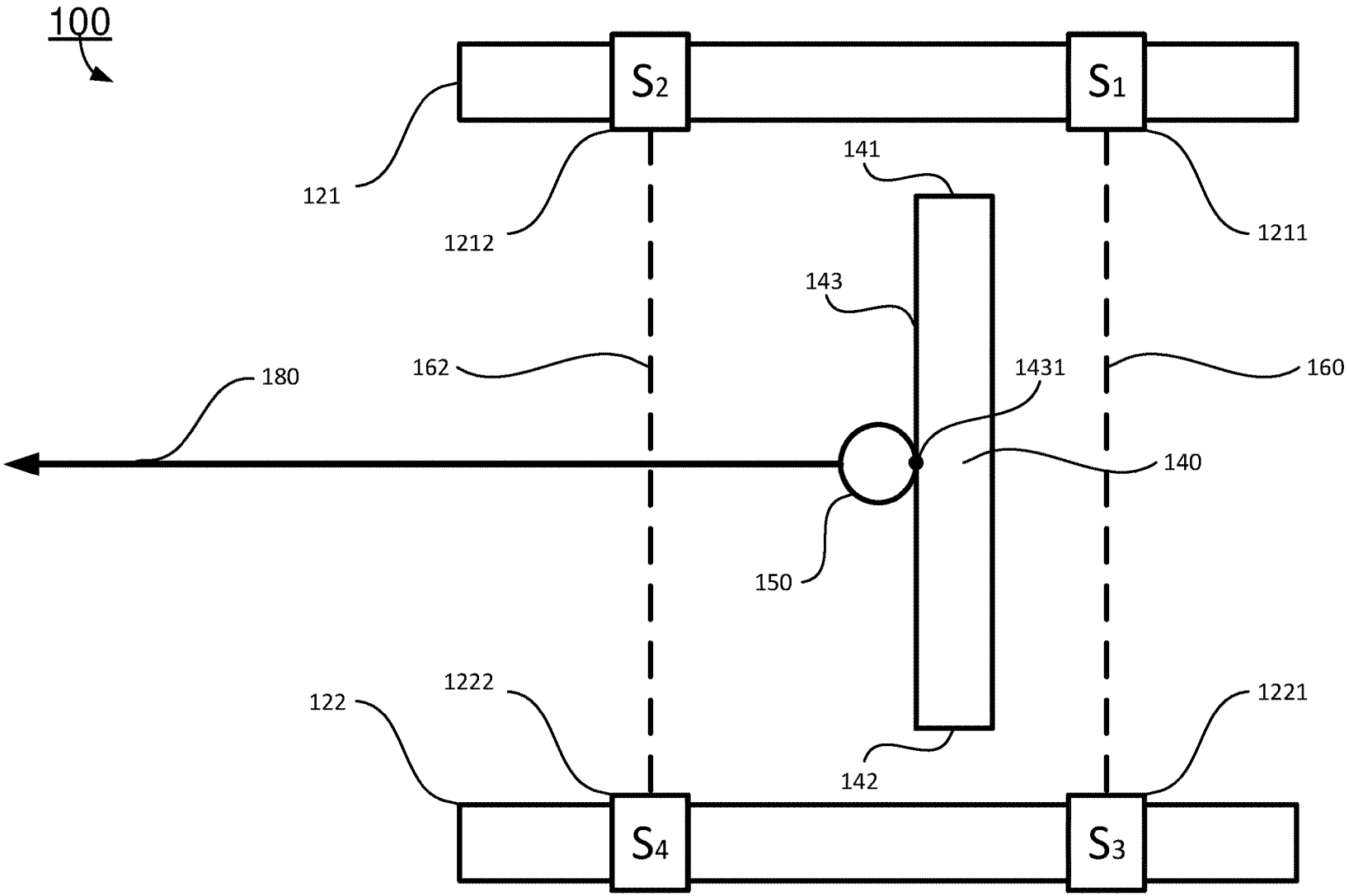
FIG. 1 shows a structure diagram of a sensor array according to certain embodiments of the present disclosure.

The present disclosure is more particularly described in the following examples that are intended as illustrative only since numerous modifications and variations therein will be apparent to those skilled in the art. Various embodiments of the disclosure are now described in detail. Referring to the drawings, like numbers, if any, indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present disclosure. Additionally, some terms used in this specification are more specifically defined below.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the disclosure or of any exemplified term. Likewise, the disclosure is not limited to various embodiments given in this specification.

Unless otherwise defined, all technical and scientific terms used herein have the same meaning as commonly understood by one of ordinary skill in the art to which this disclosure pertains. In the case of conflict, the present document, including definitions will control.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, "plurality" means two or more.

As used herein, the terms "comprising," "including," "carrying," "having," "containing," "involving," and the like are to be understood to be open-ended, i.e., to mean including but not limited to.

As used herein, the phrase at least one of A, B, and C should be construed to mean a logical (A or B or C), using a non-exclusive logical OR. It should be understood that one or more steps within a method may be executed in different order (or conconventionally) without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

The present disclosure will now be described more fully hereinafter with reference to the accompanying drawings, in which embodiments of the disclosure are shown. This disclosure may, however, be embodied in many different forms and should not be construed as limited to the embodiments set forth herein; rather, these embodiments are provided so that this disclosure will be thorough and complete, and will fully convey the scope of the disclosure to those skilled in the art. Like numbers refer to like elements throughout.

Referring now to FIGS. 1-6, in one aspect, the present disclosure relates to a sensor array 100. In certain embodiments, the sensor array 100 includes: a first sensor ($S_1$) 1211, a second sensor ($S_2$) 1212, a third sensor ($S_3$) 1221, and a fourth sensor ($S_4$) 1222. The first sensor 1211 and the second sensor 1212 are installed on a first sensor support member 121. The third sensor 1221 and the fourth sensor 1222 are installed on a second sensor support member 122. The first sensor 1211, the second sensor 1212, the third sensor 1221 and the fourth sensor 1222 form a rectangular shape. A golf ball 150 is placed in the center of the rectangular shape. The first sensor 1211 and the third sensor 1221 form a pre-strike reference line 160, and the second sensor 1212 and the fourth sensor 1222 form a post-strike reference line 162. When a golfer swings a putter 140 from the right to the left passing the pre-strike reference line 160, hitting the golf ball 150, and passing the post-strike reference line 162, the sensor array 100 collects putting drill data. The putting drill data collected includes: a striking speed of the putter 140, a striking angle 190 of the putter 140, and whether a striking surface 143 of the putter 140 hits a sweet spot 1431 of the putter 140.

Figure 4:
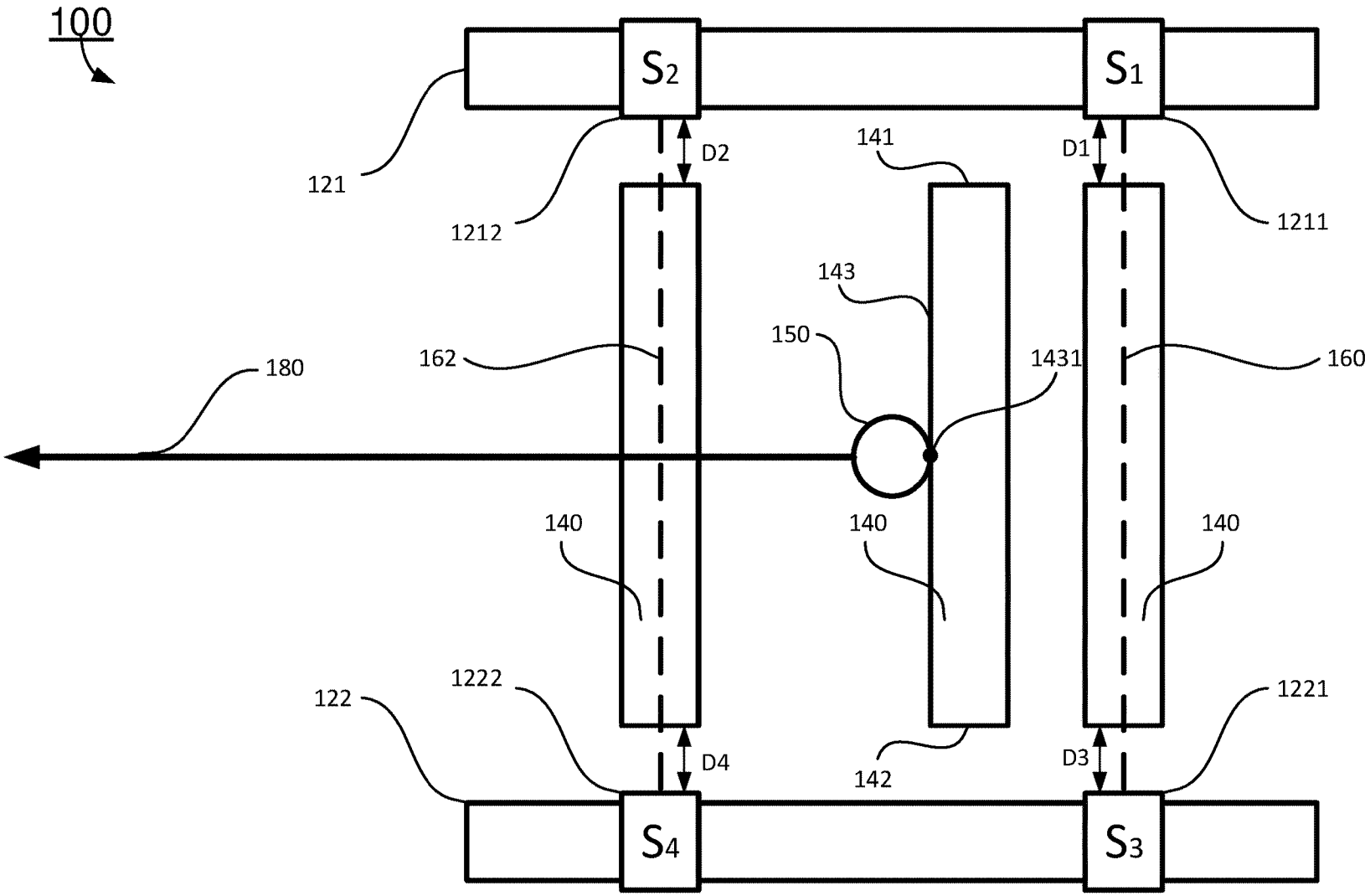
FIG. 4 shows a structure diagram of the sensor array showing a path of the putter from right to left and strikes the golf ball on a sweet spot of the putter according to certain embodiments of the present disclosure.

In certain embodiments, as shown in FIG. 1 and FIG. 4, when the putter 140 swings from the pre-strike reference line 160 to the post-strike reference line 162, perpendicular to the first sensor support member 121 and the second sensor support member 122, and a first distance D1 equals a third distance D3, and a second distance D2 equals a fourth distance D4, the striking surface 143 of the putter 140 strikes the sweet spot 1431 of the putter 140, and the golf ball 150 moves in a straight line 180 forward.

Figure 2:
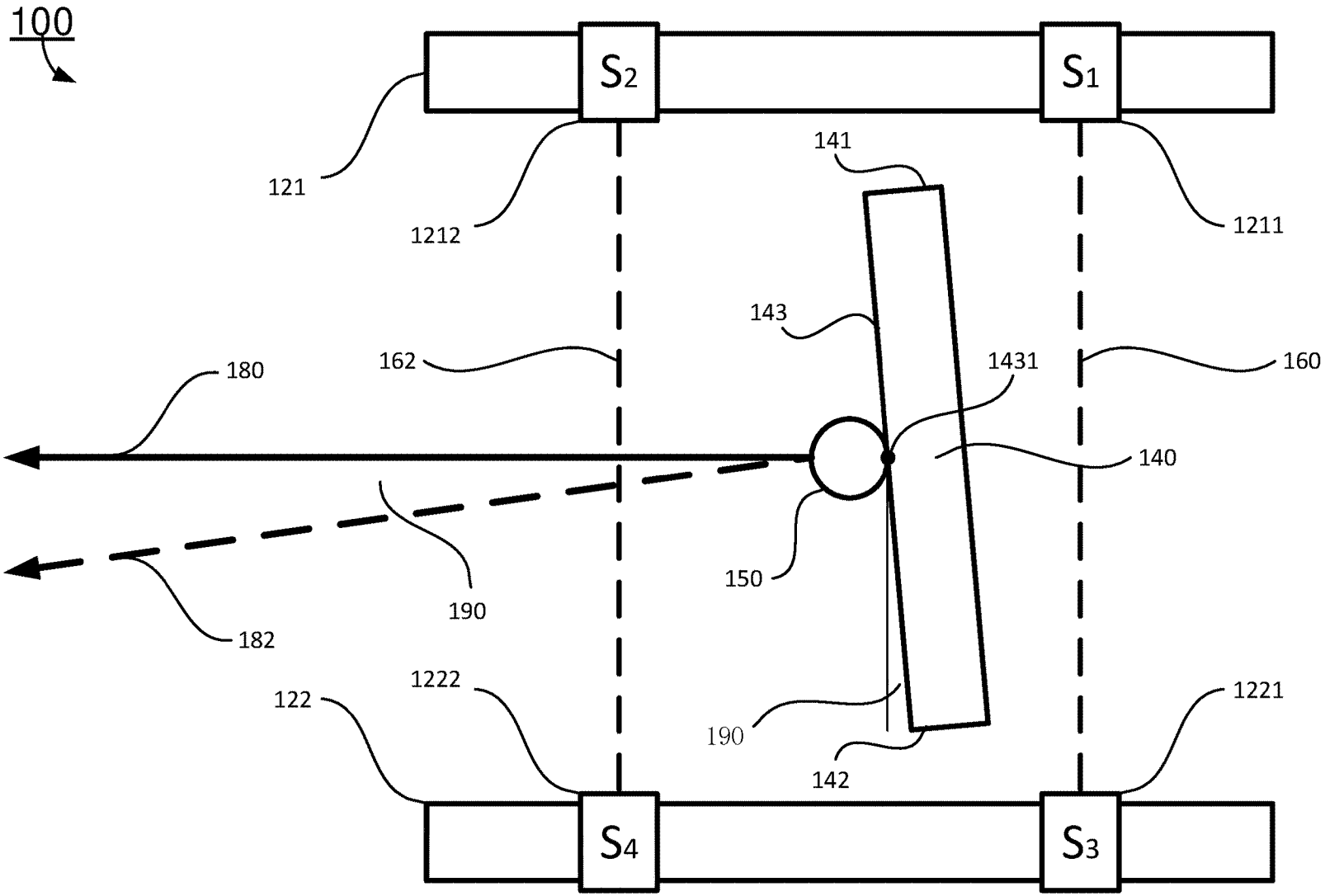
FIG. 2 shows a structure diagram of the sensor array showing a putter strike a golf ball on a close direction according to certain embodiments of the present disclosure.
Figure 5:
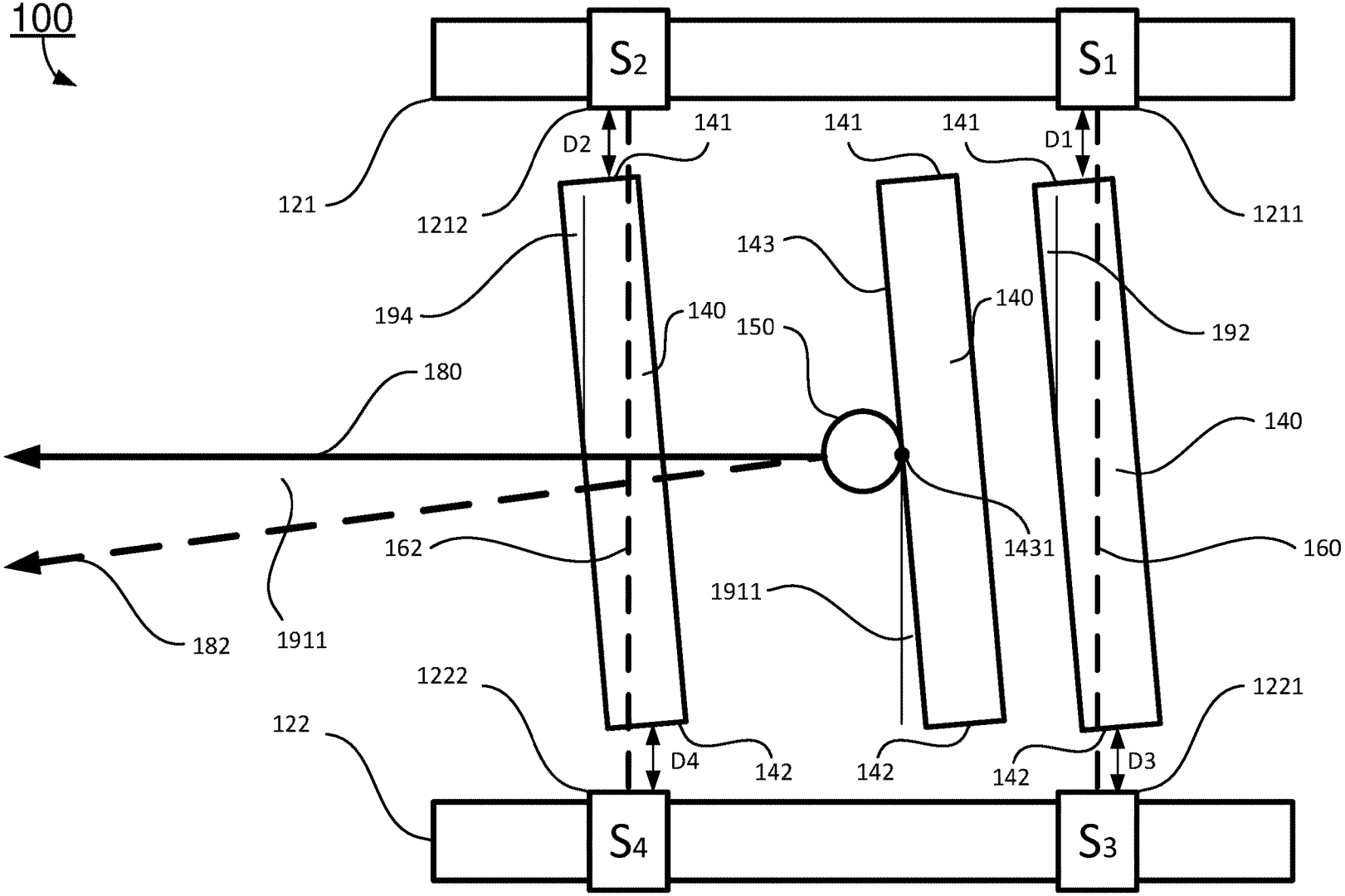
FIG. 5 shows a structure diagram of the sensor array showing a path of the putter from right to left and strikes the golf ball on a close direction according to certain embodiments of the present disclosure.

In certain embodiments, as shown in FIG. 2 and FIG. 5, when the putter 140 swings from the pre-strike reference line 160 to the post-strike reference line 162, with a slight angle 190 slightly downwards, the striking surface 143 of the putter 140 strikes the golf ball 150 in a close direction 182.

Figure 3:
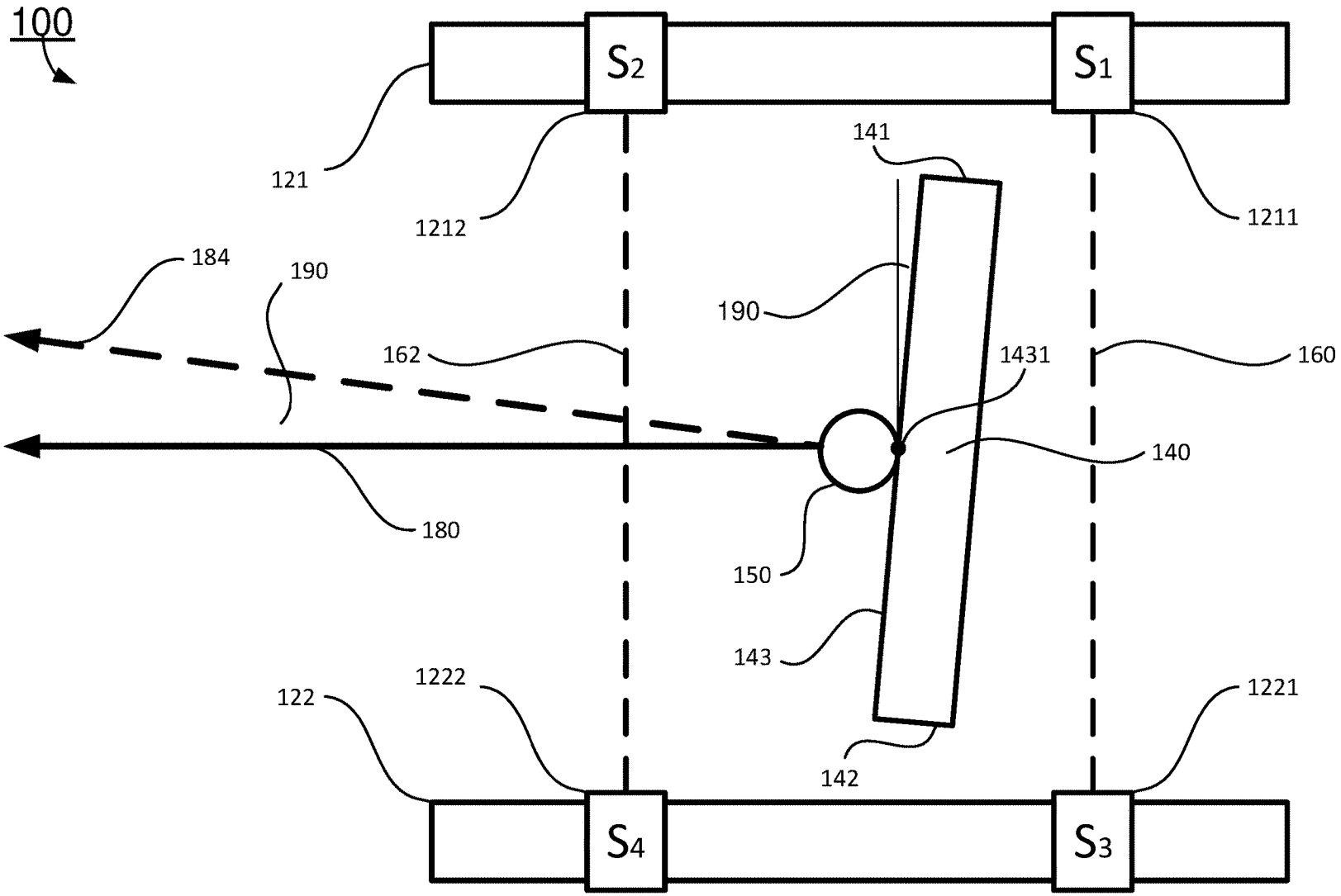
FIG. 3 shows a structure diagram of the sensor array showing the putter strike the golf ball on an open direction according to certain embodiments of the present disclosure.
Figure 6:
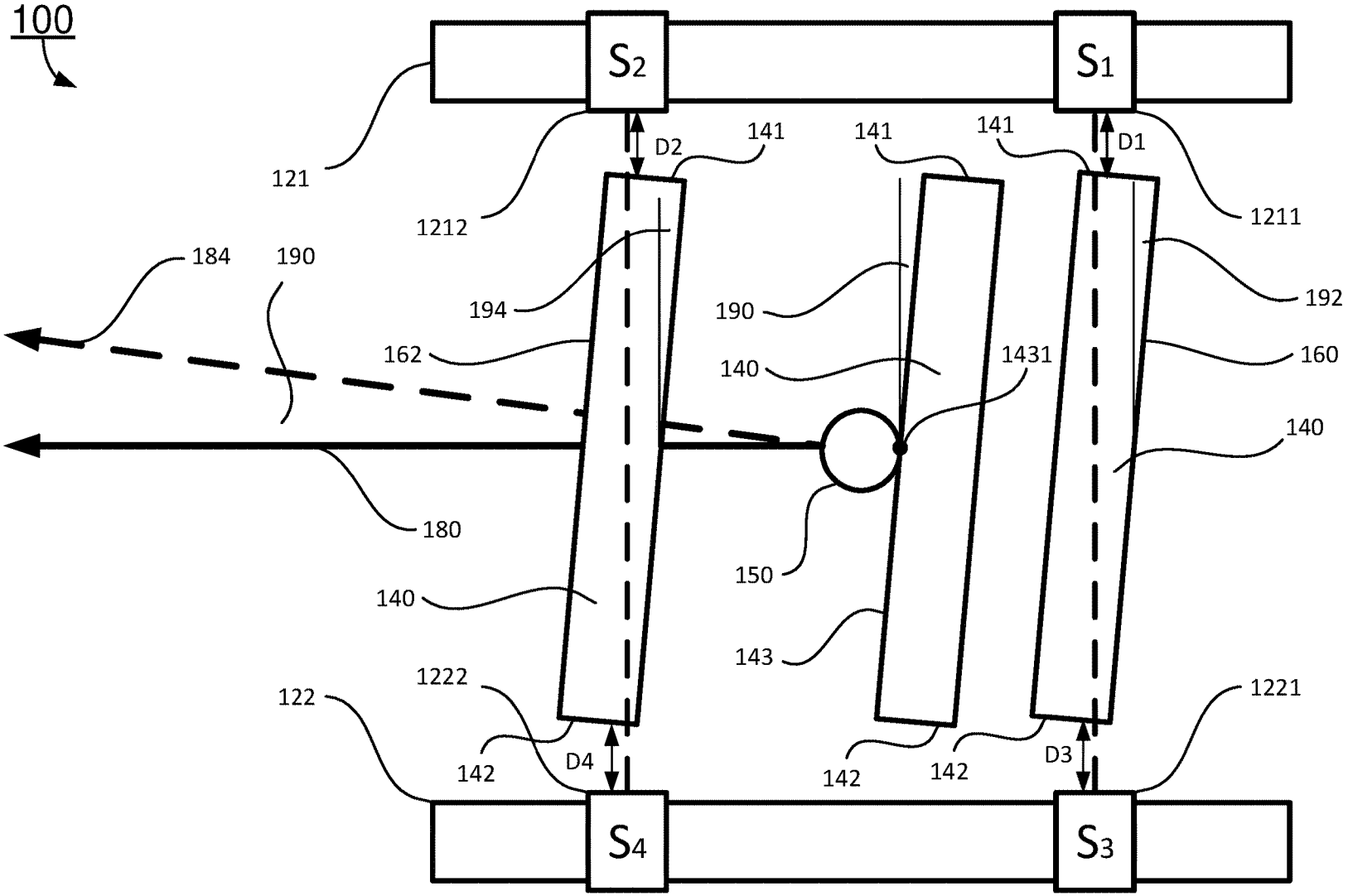
FIG. 6 shows a structure diagram of the sensor array showing a path of the putter from right to left and strikes the golf ball on an open direction according to certain embodiments of the present disclosure.

In certain embodiments, as shown in FIG. 3 and FIG. 6, when the putter 140 swings from the pre-strike reference line 160 to the post-strike reference line 162, with a slight angle 190 slightly upwards, the striking surface 143 of the putter 140 strikes the golf ball 150 in an open direction 184.

In certain embodiments, the sensor array 100 includes at least one of: a set of laser sensors, a set of optical sensors, a set of ultrasonic sensors, a set of electromagnetic sensors, and a combination of these sensors.

In certain embodiments, as shown in FIGS. 4-6, when a first end 141 of the putter 140 travels between the first sensor 1211 and the second sensor 1212, a time travelled by the first end 141 of the putter 140 between the first sensor 1211 and the second sensor 1212 determines a first striking speed of the putter 140. When a second end 142 of the putter 140 travels between the third sensor 1221 and the fourth sensor 1222, a time travelled by the second end 142 of the putter 140 between the third sensor 1221 and the fourth sensor 1222 determines a second striking speed of the putter 140. The striking speed of the putter 140 is an average of the first striking speed of the putter 140 and the second striking speed of the putter 140.

In certain embodiments, as shown in FIGS. 4-6, when the putter 140 is swing from right to left passing the pre-strike reference line 160 between the first sensor 1211 and the third sensor 1221, the first sensor 1211 and the third sensor 1221 detects a pre-striking angle 192 of the putter 140. When the putter 140 is swing from right to left passing the post-strike reference line 162 between the second sensor 1212 and the fourth sensor 1222, the second sensor 1212 and the fourth sensor 1222 detects a post-striking angle 194 of the putter 140. The striking angle 190 of the putter 140 is an average of the pre-striking angle 192 of the putter 140 and the post-striking angle 194 of the putter 140.

In certain embodiments, as shown in FIGS. 4-6, when the putter 140 is swing from right to left passing the pre-strike reference line 160 between the first sensor 1211 and the third sensor 1221, the first sensor 1211 detects the first distance D1 between the first end 141 of the putter 140 to the first sensor 1211, and the third sensor 1221 detects the third distance D3 between the second end 142 of the putter 140 to the third sensor 1221. When the putter 140 is swing from right to left passing the post-strike reference line 162 between the second sensor 1212 and the fourth sensor 1222, the second sensor 1212 detects the second distance D2 between the first end 141 of the putter 140 to the second sensor 1212. The fourth sensor 1222 detects the fourth distance D4 between the second end 142 of the putter 140 to the fourth sensor 1222. When the first distance D1 equals the third distance D3, and the second distance D2 equals the fourth distance D4, the putter 140 hits the sweet spot 1431 of the putter 140.

Figure 7:
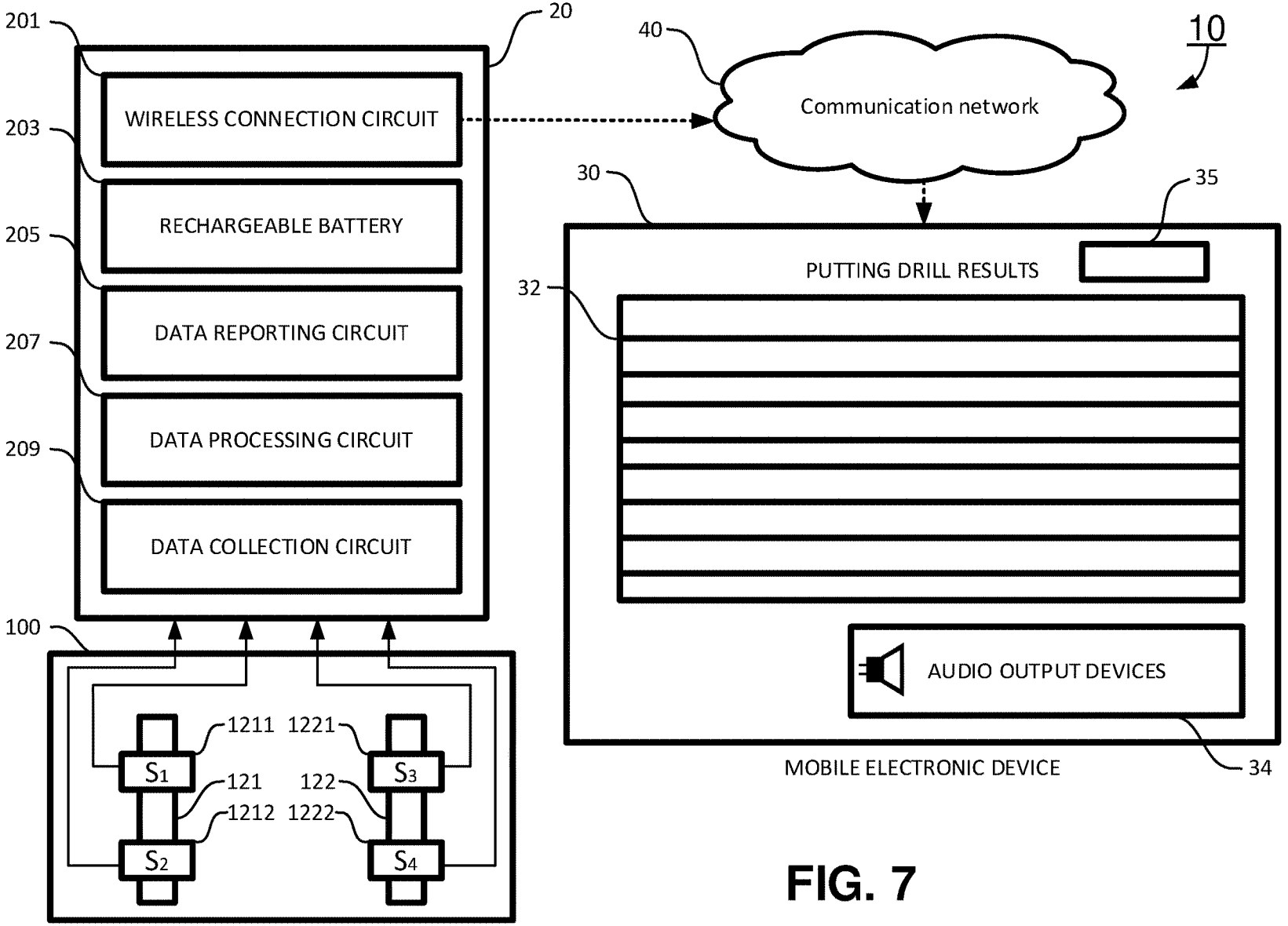
FIG. 7 shows a block diagram of a portable putting drill system according to certain embodiments of the present disclosure.

In another aspect, as shown in FIG. 7, the present disclosure relates to a portable putting drill system 10. In certain embodiments, the portable putting drill system 10 includes: a sensor array 100, a drill data collection circuit 20, and a mobile electronic device 30. The sensor array 100 collects putting drill data including a striking speed of a putter 140, a striking angle 190 of the putter 140, and whether a striking surface 143 of the putter 140 hits a sweet spot 1431 of the putter 140. The drill data collection circuit 20 includes: a data collection circuit 209 for receiving the putting drill data collected by the sensor array 100, a data processing circuit 207 for processing the putting drill data received, a data reporting circuit 205 for reporting the results of putting drill data processed, and a wireless connection circuit 201 for transmitting results of putting drill data processed to the mobile electronic device 30 wirelessly over a communication network 40. The mobile electronic device 30 displays the processed putting drill data, and provides audio output to a user in real time to enhance the putting drill experience.

In certain embodiments, as shown in FIG. 1, the sensor array 100 includes: a first sensor ($S_1$) 1211, a second sensor ($S_2$) 1212, a third sensor ($S_3$) 1221, and a fourth sensor ($S_4$) 1222. The first sensor 1211 and the second sensor 1212 are installed on a first sensor support member 121. The third sensor 1221 and the fourth sensor 1222 are installed on a second sensor support member 122. The first sensor 1211, the second sensor 1212, the third sensor 1221 and the fourth sensor 1222 form a rectangular shape. The first sensor 1211 and the third sensor 1221 form a pre-strike reference line 160, and the second sensor 1212 and the fourth sensor 1222 form a post-strike reference line 162. The sensor array 100 collects putting drill data.

In certain embodiments, the sensor array 100 includes at least one of: a set of laser sensors, a set of optical sensors, a set of ultrasonic sensors, a set of electromagnetic sensors, and a combination of these sensors.

In certain embodiments, when a first end 141 of the putter 140 travels between the first sensor 1211 and the second sensor 1212, a time travelled by the first end 141 of the putter 140 between the first sensor 1211 and the second sensor 1212 determines a first striking speed of the putter 140. When a second end 142 of the putter 140 travels between the third sensor 1221 and the fourth sensor 1222, a time travelled by the second end 142 of the putter 140 between the third sensor 1221 and the fourth sensor 1222 determines a second striking speed of the putter 140. The striking speed of the putter 140 is an average of the first striking speed of the putter 140 and the second striking speed of the putter 140.

In certain embodiments, when the putter 140 is swing from right to left passing the pre-strike reference line 160 between the first sensor 1211 and the third sensor 1221, the first sensor 1211 and the third sensor 1221 detects a pre-striking angle 192 of the putter 140. When the putter 140 is swing from right to left passing the post-strike reference line 162 between the second sensor 1212 and the fourth sensor 1222, the second sensor 1212 and the fourth sensor 1222 detects a post-striking angle 194 of the putter 140, and the striking angle 190 of the putter 140 is an average of the pre-striking angle 192 of the putter 140 and the post-striking angle 194 of the putter 140.

In certain embodiments, when the putter 140 is swing from right to left passing the pre-strike reference line 160 between the first sensor 1211 and the third sensor 1221, the first sensor 1211 detects a first distance D1 between the first end 141 of the putter 140 to the first sensor 1211, and the third sensor 1221 detects a third distance D3 between the second end 142 of the putter 140 to the third sensor 1221, when the putter 140 is swing from right to left passing the post-strike reference line 162 between the second sensor 1212 and the fourth sensor 1222, the second sensor 1212 detects a second distance D2 between the first end 141 of the putter 140 to the second sensor 1212, and the fourth sensor 1222 detects a fourth distance D4 between the second end 142 of the putter 140 to the fourth sensor 1222, and when the first distance D1 equals the third distance D3, and the second distance D2 equals the fourth distance D4, the putter 140 hits the sweet spot 1431 of the putter 140.

In certain embodiments, the communication network 40 includes: a Wi-Fi network, a Bluetooth network, an infrared network, a Zigbee network, a wireless local area network (WLAN), a wireless metropolitan area network (WMAN), a wireless wide area network (WWAN), a cellular network, and a mobile communication network.

In certain embodiments, in one embodiment, the mobile electronic device 30 includes an Apple iPad. In another embodiment, the mobile electronic device 30 includes a mobile smart phone, such as an Apple iPhone operating an iOS operating system, a Samsung smart phone or any smart phone operating an Android operating system. In yet another embodiment, the mobile electronic device 30 includes a tablet computer such as a Microsoft Surface, a Google Pixel Tablet, a Lenovo Ideapad Tablet, a Sumsung Galaxy Tab, or any other portable tablet computers.

In certain embodiments, the putting drill data is displayed on the mobile electronic device 30 in real time during the putting drill for the user to view, and audio output of the mobile electronic device 30 provides coaching in real time during the drill to improve the putting drill. The user receives the audio output of the mobile electronic device 30 through an audio output device 34. The audio output device 34 of the mobile electronic device 30 includes an internal speaker of the mobile electronic device 30, wirelessly connected earphones, earbuds, headsets, headphones and Apple AirPods.

In certain embodiments, the portable putting drill system 10 further includes a rechargeable battery 203. The rechargeable battery 203 includes at least one of: a lead-acid rechargeable battery, a nickel cadmium (NiCd) rechargeable battery, a nickel metal hydride (NiMH) rechargeable battery, a lithium ion (Li-ion) rechargeable battery, and a lithium-ion polymer (Li-ion polymer) rechargeable battery.

Referring now to FIG. 8, an exemplary report form 32 of results of putting drill is shown during a round of putting drill according to certain embodiments of the present disclosure. Prior to the putting drill, the user shall enter certain information and goal of the drill about to start. The information and goal of the drill includes: name of putting drill participant, the date of the putting drill, the location of the putting drill, projected putter speed in miles per hour, Green Rate, golf course slop, angle between the club hole and the fairway, and number of putting drill for each round. In one embodiment, name of putting drill participant is John Doe, the date is Oct. 15, 2023, the location of the putting drill is home, the projected putter speed is 2.0 miles per hour (mph), and the green rate of 6.3, the Slope includes: Uphill: 2%, Downhill: 3%, and Slope: 9%. The angle between the club hole and the fairway is 32°. In one embodiment, the number of putting drill for each round is set to 20. A counter 35 is set to zero before the putting drill starts. Number of putter strike is displayed in Strike No column 320.

Once the information and the goal of the drill is entered by the putting drill participant, the putting drill can start. A golf ball 150 is placed in the center of the rectangle of the sensor array 100. Once the golfer swings the putter 140 through the center of the rectangle of the sensor array 100, the counter 35 automatically increment by 1, and the putting drill data is detected and transmitted wirelessly to the mobile electronic device 30.

When a first end 141 of the putter 140 travels between the first sensor 1211 and the second sensor 1212, a time travelled by the first end 141 of the putter 140 between the first sensor 1211 and the second sensor 1212 determines a first striking speed of the putter 140. When a second end 142 of the putter 140 travels between the third sensor 1221 and the fourth sensor 1222, a time travelled by the second end 142 of the putter 140 between the third sensor 1221 and the fourth sensor 1222 determines a second striking speed of the putter 140. The putter speed is an average of the first striking speed of the putter 140 and the second striking speed of the putter 140. The putter speed in miles per hour (mph) is displayed in the report form 32 of the results of putting drill in the Putter Speed column 321.

In certain embodiments, when the putter 140 is swing from right to left passing the pre-strike reference line 160 between the first sensor 1211 and the third sensor 1221, the first sensor 1211 and the third sensor 1221 detects a pre-striking angle 192 of the putter 140. The Pre-strike Angle is displayed in Pre-strike Angle column 322. In the Pre-strike Angle column 322, there are two sub-columns: an open sub-column 3221, and a close sub-column 3222. The open sub-column 3221 and the close sub-column 3222 indicate whether current strike is either in open direction 184, as shown in FIG. 3, and FIG. 6, or in close direction 182, as shown in FIG. 2, and FIG. 5. Since one strike of the putter 140 can only be one of the two directions, therefore, the pre-strike angle 192 can be displayed only in one of the two sub-columns 3221 or 3222.

In certain embodiments, when the putter 140 is swing from right to left passing the post-strike reference line 162 between the second sensor 1212 and the fourth sensor 1222, the second sensor 1212 and the fourth sensor 1222 detects a post-striking angle 194 of the putter 140. The Pre-strike Angle is displayed in Pre-strike Angle column 322. In the Post-strike Angle column 323, there are two sub-columns: an open sub-column 3231, and a close sub-column 3232. The open sub-column 3231 and the close sub-column 3232 indicate whether current strike is either in open direction 184, as shown in FIG. 3, and FIG. 6, or in close direction 182, as shown in FIG. 2, and FIG. 5. Since one strike of the putter 140 can only be one of the two directions, therefore, the post-strike angle 194 can be displayed only in one of the two sub-columns 3231 or 3232.

In certain embodiments, the striking angle 190 of the putter 140 is an average of the pre-striking angle 192 of the putter 140 and the post-striking angle 194 of the putter 140.

In certain embodiments, when the putter 140 is swing from right to left passing the pre-strike reference line 160 between the first sensor 1211 and the third sensor 1221, the first sensor 1211 detects a first distance D1 between the first end 141 of the putter 140 to the first sensor 1211, and the third sensor 1221 detects a third distance D3 between the second end 142 of the putter 140 to the third sensor 1221. The Pre-strike distance is defined as (D1-D3), or the first distance D1 minus the third distance D3. The Pre-strike distance is displayed in Pre-strike distance column 324. In the Pre-strike distance column 324, there are two sub-columns: a Down sub-column 3241, and an Up sub-column 3242. The Down sub-column 3241 and the Up sub-column 3242 indicate whether current strike is either slightly lower than the center of the sensor array 100, or slightly higher than the center of the sensor array 100. Since one strike of the putter 140 can only be one of the two positions, therefore, the Pre-strike distance (D1-D3) can be displayed only in one of the two sub-columns 3241 or 3242.

In certain embodiments, when the putter 140 is swing from right to left passing the post-strike reference line 162 between the second sensor 1212 and the fourth sensor 1222, the second sensor 1212 detects a second distance D2 between the first end 141 of the putter 140 to the second sensor 1212, and the fourth sensor 1222 detects a fourth distance D4 between the second end 142 of the putter 140 to the fourth sensor 1222. The Post-strike distance is defined as (D2-D4), or the second distance D2 minus the fourth distance D4. The Pre-strike distance is displayed in Post-strike distance column 325. In the Post-strike distance column 325, there are two sub-columns: a Down sub-column 3251, and an Up sub-column 3252. The Down sub-column 3251 and the Up sub-column 3252 indicate whether current strike is either slightly lower than the center of the sensor array 100, or slightly higher than the center of the sensor array 100. Since one strike of the putter 140 can only be one of the two positions, therefore, the Post-strike distance (D2-D4) can be displayed only in one of the two sub-columns 3251 or 3252.

In certain embodiments, when the first distance D1 equals the third distance D3, and the second distance D2 equals the fourth distance D4, the putter 140 hits the sweet spot 1431 of the putter 140.

After each the putter 140 strike of the golf ball 150, the putter speed, the pre-strike angle, the post-strike angle, the pre-strike distance, and the post-strike distance are transmitted wirelessly to the mobile electronic device 30, the report form 32 of results of putting drill is populated and displayed in appropriate columns and sub-columns on the display area of the mobile electronic device 30. The putting drill participant then receives a voice prompt regarding the putter speed in mph, the strike angle 190 in degrees either in open direction or in close direction, and the putter position whether the putter is down or up from the center line and the offset in inches. For example, as shown in FIG. 8, after the first putt, the voice feed back may include: "nice job, the putter speed is 2.20 mph, the strike angle is 2.1 degrees in close direction, the putter is about one inch below the center line." In this way, the putting drill participant can review the results of this strike, hear the voice feedback, and make certain adjustment for the next strike to improve strike accuracy.

After pre-determined number of putter strikes, the statistics of the current putting drill data is calculated and display at the bottom of the report form 32 of results of putting drill. Average offsets of the putting drill data are displayed in row 326, and offset percentages of the putting drill data are displayed in row 327. The average offset of the putter speed is displayed in the intersection of column 321 and row 326. The putter speed of this round the putting drill is 2.33 mph, calculated by averaging all 20 putter speeds of this round. The offset percentage of the putter speed is 16.50%, calculated by (2.33−2.00)/2.00.

There are 12 putter pre-strike in open direction and the average of open offset is 3.55, calculated be averaging all 12 open pre-strike in degrees, and displayed in the intersection of column 3221 and row 326, or 60% putter strikes in open direction, displayed in the intersection of column 3221 and row 327. There are 8 putter pre-strike in close direction and the average of close offset is 4.03, calculated be averaging all 8 close pre-strike in degrees, and displayed in the intersection of column 3222 and row 326, or 40% putter strikes in close direction, displayed in the intersection of column 3222 and row 327.

There are 6 putter post-strike in open direction and the average of open offset is 3.78, calculated be averaging all 6 open post-strike in degrees, and displayed in the intersection of column 3231 and row 326, or 30% putter strikes in open direction, displayed in the intersection of column 3231 and row 327. There are 14 putter post-strike in close direction and the average of close offset is 5.85, calculated be averaging all 14 close post-strike in degrees, and displayed in the intersection of column 3232 and row 326, or 70% putter strikes in close direction, displayed in the intersection of column 3232 and row 327.

There are 11 post-strike putts lower than a center line of the sensor array 100 and the average down offset is 1.01 inch, calculated be averaging all 11 post-strike down offset in inch, and displayed in the intersection of column 3251 and row 326, or 55% post-strike putter strikes, displayed the intersection of column 3251 and row 327. There are 7 post-strike putts higher than the center line of the sensor array 100, and the average up offset is 1.03 inch, calculated be averaging all 7 pre-strike up offset in inch, and displayed in the intersection of column 3252 and row 326, or 35% pre-strike putter strikes, displayed in the intersection of column 3252 and row 327.

There are two putter strikes (9th and 19th) actually hit along the center line of the sensor array 100, that is 10% putter strikes hits the sweet spots 1431 of the putter 140.

After each round of putting drill, the report form 32 of results of putting drill is saved in the mobile electronic device 30, and the putting drill participant can analyze the saved the results and statistics of the putting drill data to improve his/her golf skill in the future practice.

In yet another aspect, the present disclosure relates to a method of using a portable putting drill system 10. In certain embodiments, the method includes following operations:

- setting up, by a user, the portable putting drill system 10 on a green of a golf course or on an indoor putting drill area, and the portable putting drill system 10 includes a sensor array 100, a drill data collection circuit 20, and a mobile electronic device 30;
- entering, by the user on the mobile electronic device 30, putting drill information and goal. The putting drill information and goal includes: name of putting drill participant, the date of the putting drill, the location of the putting drill, projected putter speed in miles per hour, Green Rate, golf course slop, angle between the club hole and the fairway, and number of putting drill for each round;
- starting, by the user, a putting drill by setting a counter 35 to zero, and swing a gold putter 140 at a golf ball 150 positioned at a center of the sensor array 100 from right to left;
- collecting, by the drill data collection circuit 20 through the sensor array 10, putting drill data after each putter 140 strike, and the putting drill data includes a striking speed of a putter 140, a striking angle 190 of the putter 140, and whether a striking surface 143 of the putter 140 hits a sweet spot 1431 of the putter 140;
- incrementing the counter 35 by one after each putter 140 strike, and the drill data collection circuit 20 collects putting drill data for this strike through the sensor array 10, processes the putting drill data, and reports to the user through the mobile electronic device 30 for audio or visual feedback to the user;
- displaying, by the mobile electronic device 30 after each putter 140 strike, statistics of current round of putting drill data for the user to review, and audio and visual feedback to the user to improve future putting drill;
- when the counter 35 of the mobile electronic device 30 does not reach the number of strikes for each round, the method continues to collecting putting drill data step;
- when the counter 35 of the mobile electronic device 30 reaches the number of strikes for each round, the method asks the user whether to continue the putting drill, or end the putting drill;
- the method continues to start over another round of putting drill when the user chooses to continue the putting drill;
- the method ends when the user chooses to terminate the putting drill.

In certain embodiments, the portable putting drill system 10 includes: the sensor array 100, the drill data collection circuit 20, and the mobile electronic device 30. The sensor array 100 collects putting drill data. The drill data collection circuit 20 includes: a data collection circuit 209 for receiving the putting drill data collected by the sensor array 100, a data processing circuit 207 for processing the putting drill data received, a data reporting circuit 205 for reporting the results of putting drill data processed, and a wireless connection circuit 201 for transmitting the results of putting drill data processed to the mobile electronic device 30 wirelessly over a communication network 40. The mobile electronic device 30 displays the processed putting drill data, and provides audio output to a user in real time to enhance the putting drill experience.

In certain embodiments, the sensor array 100 includes: a first sensor 1211, a second sensor 1212, a third sensor 1221, and a fourth sensor 1222. The first sensor 1211 and the second sensor 1212 are installed on a first sensor support member 121, and the third sensor 1221 and the fourth sensor 1222 are installed on a second sensor support member 122. The first sensor 1211, the second sensor 1212, the third sensor 1221 and the fourth sensor 1222 form a rectangle shape. The first sensor 1211 and the third sensor 1221 form a pre-strike reference line 160, and the second sensor 1212 and the fourth sensor 1222 form a post-strike reference line 162. The sensor array 100 collects putting drill data, and the sensor array 100 includes at least one of: a set of laser sensors, a set of optical sensors, a set of ultrasonic sensors, a set of electromagnetic sensors; and a combination of these sensors.

In certain embodiments, the mobile electronic device 30 includes an Apple iPad, a mobile smart phone, and a tablet computer. The user receives the audio output of the mobile electronic device 30 through an audio output device 34, and the audio output device 34 of the mobile electronic device 30 includes an internal speaker of the mobile electronic device 30, wirelessly connected earphones, earbuds, headsets, headphones and Apple AirPods.

Figure 9:
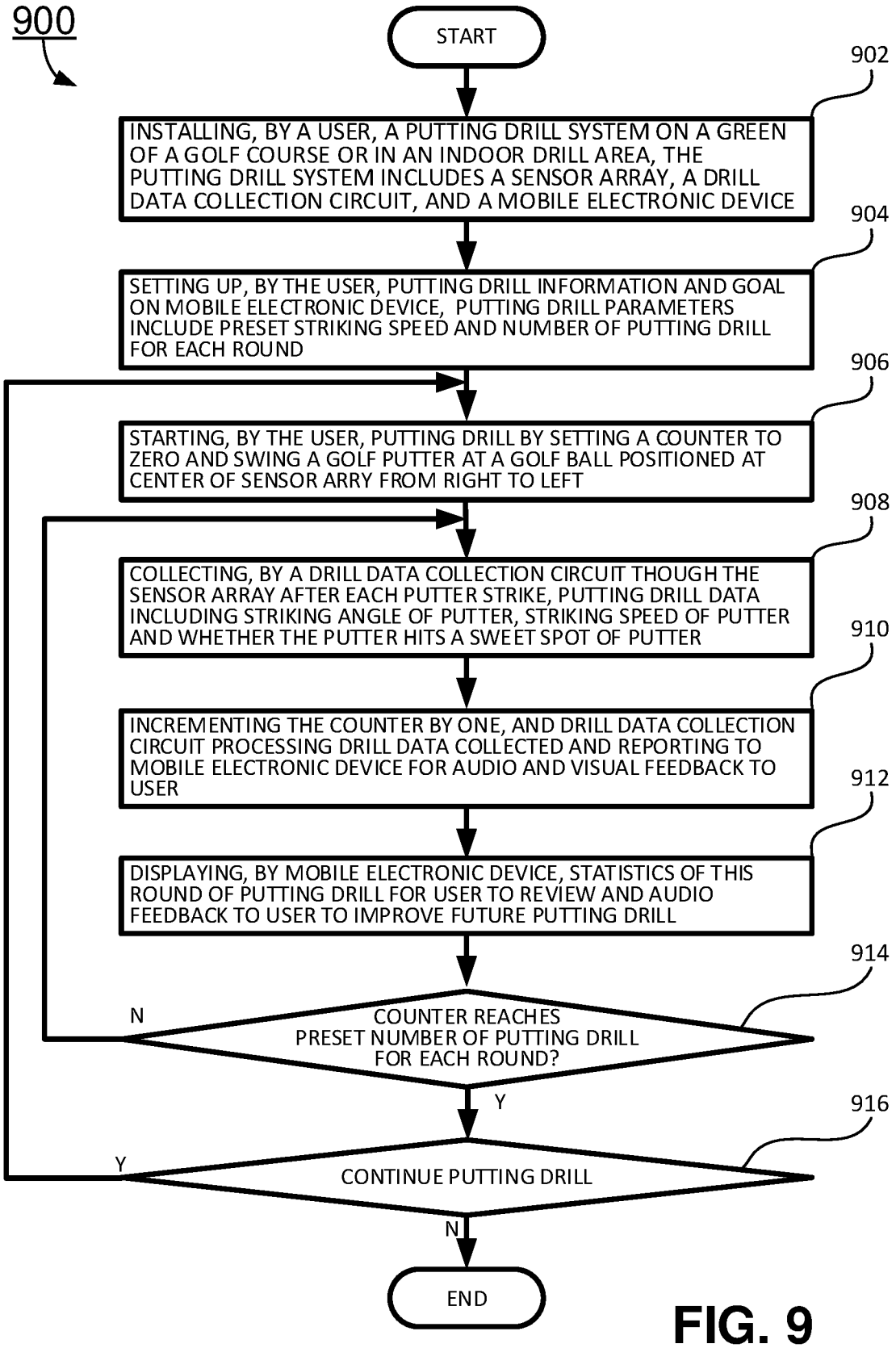
FIG. 9 shows a method of using the portable putting drill system according to certain embodiments of the present disclosure.

Referring now to FIG. 9, a method 900 of using the portable putting drill system 10 is shown according to certain embodiments of the present disclosure.

At block 902, installing, by a user, a portable putting drill system 10 on a green of a golf course or in an indoor drill area, the portable putting drill system 10 includes a sensor array 100, a drill data collection circuit 20, and a mobile electronic device 30.

At block 904, setting up, by the user, putting drill information and goal on mobile electronic device 30. The putting drill information and goal includes: name of putting drill participant, the date of the putting drill, the location of the putting drill, projected putter speed in miles per hour, Green Rate, golf course slop, angle between the club hole and the fairway, and number of putting drill for each round.

At block 906, starting, by the user, putting drill by setting a counter 35 to zero and swing a golf putter 140 at a golf ball 150 positioned at a center of sensor array 100 from right to left.

At block 908, collecting, by a drill data collection circuit 20 though the sensor array 100 after each putter strike, putting drill data including striking angle of the putter 140, striking speed of the putter 140 and whether the putter 140 hits a sweet spot 1431 of the putter 140.

At block 910, incrementing the counter 35 by one, and the drill data collection circuit 20 processing putting drill data collected and reporting to the mobile electronic device 30 for audio and visual feedback to the user.

At block 912, displaying, by the mobile electronic device 30, statistics of this round of putting drill for user to review and audio feedback to user to improve future putting drill.

At query block 914, checking whether the counter 35 reaches the preset number of putting drill for each round. In one embodiment, this round includes 20 putting practice. When the counter 35 is less than 20, the method 900 has not completed this round and proceeds to block 908 to next putting practice. When the counter 35 equals 20, the method 900 completes this round of putting drill and proceeds to block 916.

At query block 916, the mobile electronic device 30 asks the user whether he/she would like to continue another round of putting drill. When the user desires to continue another round of putting drill, the method 900 proceeds to block 906, and start another round of putting drill. When the user wishes to end the putting drill, the method 900 proceeds to end the putting drill.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims rather than the foregoing description and the exemplary embodiments described therein.

What is claimed is:

1. A method of using a portable putting drill system, comprising:

setting up, by one or more users, the portable putting drill system on a green of a golf course or on an indoor putting drill area, wherein the portable putting drill system comprises a sensor array, a drill data collection circuit, and a mobile electronic device;

entering, by the user on the mobile electronic device, putting drill information and goal on mobile electronic device, wherein the putting drill information and goal comprises: name of putting drill participant, the date of the putting drill, the location of the putting drill, projected putter speed in miles per hour, Green Rate, golf course slope, and angle between a club hole and a fairway, and number of putting drill for each round;

starting, by the user, a putting drill by setting a counter to zero, and swing a gold putter at a golf ball positioned at a center of the sensor array from right to left;

collecting, by the drill data collection circuit through the sensor array, putting drill data after each putter strike, wherein the putting drill data comprises a striking speed of a putter, a striking angle of the putter, and whether a striking surface of the putter hits a sweet spot of the putter;

incrementing the counter by one after each putter strike, and the drill data collection circuit collects putting drill data for this strike through the sensor array, processes the putting drill data, and reports to the user through the mobile electronic device for audio or visual feedback to the user;

displaying, by the mobile electronic device after each putter strike, statistics of current round of putting drill data for the user to review, and audio and visual feedback to the user to improve future putting drill;

when the counter of the mobile electronic device does not reach the number of strikes for each round, the method continues to collecting putting drill data step;

when the counter of the mobile electronic device reaches the number of strikes for each round, the method asks the user whether to continue the putting drill, or end the putting drill;

the method continues to start over another round of putting drill when the user chooses to continue the putting drill;

the method ends when the user chooses to terminate the putting drill.

2. The method of claim 1, wherein the portable putting drill system comprises:

the sensor array, wherein the sensor array collects putting drill data;

the drill data collection circuit, wherein the drill data collection circuit comprises a data collection circuit for receiving the putting drill data collected by the sensor array, a data processing circuit for processing the putting drill data received, a data reporting circuit for reporting the results of putting drill data processed, and a wireless connection circuit for transmitting the results of putting drill data processed to the mobile electronic device wirelessly over a communication network; and the mobile electronic device, wherein the mobile electronic device displays the processed putting drill data, and provides audio output to a user in real time to enhance the putting drill experience.

3. The method of claim 2, wherein the sensor array comprises:

a first sensor and a second sensor, wherein the first sensor and the second sensor are installed on a first sensor support member; and a third sensor and a fourth sensor, wherein the third sensor and the fourth sensor are installed on a second sensor support member, wherein the first sensor, the second sensor, the third sensor and the fourth sensor form a rectangle shape, the first sensor and the third sensor form a pre-strike reference line, the second sensor and the fourth sensor form a post-strike reference line, the sensor array collects putting drill data, and wherein the sensor array comprises at least one of: a set of laser sensors, a set of optical sensors, a set of ultrasonic sensors, a set of electromagnetic sensors; and a combination of these sensors.

4. The method of using the portable putting drill system of claim 3, wherein the mobile electronic device comprises an Apple iPad, a mobile smart phone, and a tablet computer, and the user receives the audio output of the mobile electronic device through an audio output device, wherein the audio output device of the mobile electronic device comprises an internal speaker of the mobile electronic device, wirelessly connected earphones, earbuds, headsets, headphones and Apple AirPods.

* * * * *